United States Patent [19]

Kurihara et al.

[11] 4,404,533

[45] Sep. 13, 1983

[54] ELECTROMAGNETIC SWITCH DEVICE

[75] Inventors: Norimitsu Kurihara, Wako; Katsuharu Kinoshita, Hanno; Masao Watanabe, Niiza; Toyohiro Sato, Yabuzuka Hon, all of Japan

[73] Assignee: Honda Giken Kogyo Kabushiki Kaisha, Tokyo, Japan

[21] Appl. No.: 362,997

[22] Filed: Mar. 29, 1982

[30] Foreign Application Priority Data

Mar. 27, 1981 [JP] Japan ..... 56-42215[U]
Mar. 27, 1981 [JP] Japan ..... 56-42217[U]

[51] Int. Cl.[3] ..... H01H 50/02

[52] U.S. Cl. ..... 335/131; 335/126; 335/255

[58] Field of Search ..... 335/131, 126, 255, 202, 335/133

[56] References Cited

U.S. PATENT DOCUMENTS 4,293,835 10/1981 Davis et al. ..... 335/131

*Primary Examiner*—Harold Broome
*Attorney, Agent, or Firm*—Lyon & Lyon

[57] ABSTRACT

At least one yoke member and a bobbin carrying a solenoid are accommodated within a housing, with one end wall of the housing, the yoke member and the bobbin being in axial alignment. An air passage extends through the yoke member, the bobbin and the end wall of the housing to establish communication between the atmosphere and an internal space defined within a cap member which is fixed to the other end of the housing and in which switch contacts are positioned. A sleeve is clamped at its one end between the end wall of the housing and a yoke member, and its other end terminates at an intermediate portion of the bobbin. Said other end of the housing has an annular tip caulked to the cap member along its entire circumference. Further, a stopper is disposed for pressure contact with a portion of the movable core to prohibit movement of the movable core in a direction away from the stationary core beyond a predetermined position.

14 Claims, 9 Drawing Figures

FIG. 2.
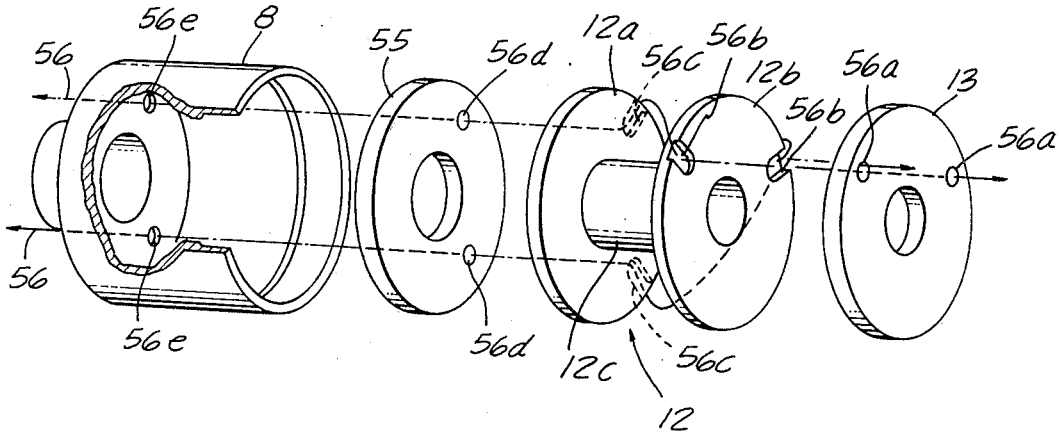
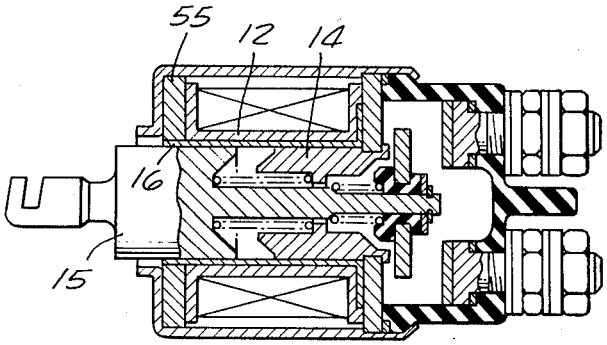
FIG. 3.
PRIOR ART
FIG. 4.
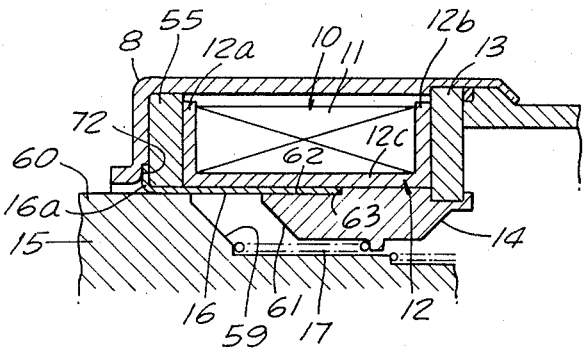

ELECTROMAGNETIC SWITCH DEVICE

BACKGROUND OF THE INVENTION

This invention relates to an electromagnetic switch device, and more particularly to improvements in an electromagnetic switch device for use with a starting motor device for engines.

An electromagnetic switch device for use with a starting motor device is conventionally generally known which comprises: a switch housing mounted on a rear housing of the starting motor device and extending rearwardly therefrom; a solenoid assembly accommodated within the switch housing and including a solenoid, a bobbin carrying the solenoid, and a yoke plate and an end plate arranged at the opposite ends of the bobbin; a movable core axially movably inserted through the solenoid assembly via a spring and carrying a moving contact at its rear end; and a cap fixed to the rear end of the switch housing and carrying a pair of fixed contacts disposed in face-to-face relation to the moving contact. The movable core is moved against the force of the spring upon energization of the solenoid to bring the moving contact into contact with the fixed contacts.

Problems in the conventional electromagnetic switch device constructed in this manner are poor smoothness of movement of the movable core and inaccurate operating position of the same.

For instance, the above-mentioned cap is joined to the switch housing in an airtight manner through a packing made of rubber for prevention of entry of alien substances into the cap. The airtightness of the internal space of the cap brings about the disadvantage that as the movable core is moved toward the stationary core, the pressure in the internal space increases above atmospheric pressure, which impedes smooth movement of the movable core. Further, the above arrangement can cause a secondary disadvantage, that is, if the air in the internal space of the cap increases in pressure by heat emitted from the engine, and then is suddenly cooled due to splash of muddy water or the like on the switch housing, the air pressure first increases and then reduces correspondingly so that external water is sucked into the internal space mainly through the junction at which the packing is located, and fouls the switch contacts in the form of droplets, causing damage to the same.

Another factor which impedes smooth movement of the movable core lies in the sleeve which is fitted in the bobbin along its inner peripheral surface. More specifically, a conventional sleeve is disposed along the substantially whole length of the yoke plate and the bobbin. To this end, the sleeve has a long surface for sliding contact with the movable core, which also impedes smooth sliding movement of the latter on the sleeve, requiring very close machine tolerances to ensure smooth movement of the movable core. Further, the sleeve has its one end secured to the yoke plate by means of an adhesive. The adhesive can flow out of the gap between the sleeve and the yoke member, impeding smooth sliding movement of the movable core.

The smooth movement of the movable core can also be impeded by distortion of the switch housing in which the coil assembly in accommodated. Distortion of the switch housing can be caused by a conventional joining method that only part of the rear end peripheral edge of the switch housing is inwardly bent or caulked to the cap in a manner preventing relative rotation.

On the other hand, according to the conventional arrangement, the starting position of the movable core is determined by the position where the tip of a hook protruding from the front end of the movable core comes into pressure contact with an associated wall surface of the rear housing of the starting motor device. However, the end face area of the hook must be small because of its limited mounting space, which causes the disadvantage that the small end face area of the hook strikes against the associated wall surface of the rear housing to form a depression in the same wall surface, resulting in a change in the starting position of the movable core.

OBJECTS AND SUMMARY OF THE INVENTION

It is therefore a primary object of the invention to provide an electromagnetic switch device in which the movable core can smoothly move to thereby achieve a stable switching operation.

It is a further object of the invention to provide an electromagnetic switch device which is free from a change in the starting position of the movable core with aging, thereby permanently maintaining its initial magnetic attraction at a constant value.

It is another object of the invention to provide an electromagnetic switch device which is free from a change in the pressure in the internal space of the switch housing accommodating the switch contacts, which would otherwise be caused by movement of the movable core, thereby avoiding the phenomenon that external water enters into the internal space to cause damage to the switch contacts and the other parts.

It is a still further object of the invention to provide an electromagnetic switch device which is provided with means for positively preventing rotation of the cap relative to the switch housing.

It is another object of the invention to provide an electromagnetic switch device which can be machined and assembled with facility and is therefore low in manufacturing cost.

The present invention provides an electromagnetic switch device which comprises: a cylindrical housing fixed to a stationary member of a device to which is applied the present electromagnetic switch device, the housing having a radially extending end wall located adjacent the stationary member; a bobbin accommodated within the housing; a solenoid carried by the bobbin; a cap member fixed to one end of the housing, which is opposite to the above end wall of the housing; an annular yoke member interposed between the housing and the cap member in a radially extending manner; a stationary core mounted inside the bobbin; the cap member defining therein an internal space in cooperation with the yoke member and the stationary core; a movable core extending in part through the stationary core into the internal space of the cap member; a fixed contact secured in the cap member; a moving contact mounted on the movable core in face-to-face relation to the fixed contact; resilient means urging the movable core in a direction away from the stationary core; the yoke member, the bobbin and the end wall of the housing being juxtaposed axially of the housing; and air passage means extending through the yoke member, the bobbin and the end wall of the housing to establish communication between the internal space in the cap member and the atmosphere outside of the electromagnetic switch device. The air passage may also extend through a second annular yoke member which may be interposed between the end wall of the housing and the bobbin in a radially extending manner.

A sleeve, which is fitted in the hollow cylindrical axial portion of the bobbin along its inner peripheral surface, has its one end clamped between the end wall of the housing and the second yoke member. The other end of the sleeve terminates within an intermediate portion of the bobbin and is supported by an annular stepped shoulder formed in at least one of the opposed surfaces of the bobbin and the stationary core.

The end portion of the housing of the present device has its inner peripheral surface formed with an annular stepped shoulder, and includes a portion extending from the annular stepped shoulder toward the cap member having a larger inner diameter than the remainder of the housing. Further, the inner peripheral surface of the end portion is formed with at least one recess located inwardly adjacent the above annular stepped shoulder. The first-mentioned yoke member includes at least one protuberance engaged in the above recess of the housing. The cap member has its one end disposed in contact with the yoke member and formed with an annular ridge on its outer peripheral surface. The end portion of the housing with a larger inner diameter has an annular end edge disposed over the annular ridge of the cap member and caulked to the cap member along its whole circumference.

Further, a stopper is provided which has a stopper surface disposed for urging contact with an enlarged main body formed on the movable core to prohibit movement of the same core in a direction away from the stationary core beyond a predetermined position.

The above and other objects, features and advantages of the invention will be more apparent from the ensuing detailed description taken in connection with the accompanying drawings in which:

BRIEF DESCRIPTION OF THE DRAWINGS

FIG. 2 is an exploded view of the main component parts of the electromagnetic switch device of FIG. 1.

FIG. 3 is a fragmentary longitudinal sectional view of a conventional sleeve mounted in a solenoid assembly and its peripheral parts.

FIG. 4 is a longitudinal sectional view of a modification of the sleeve and its peripheral parts of the electromagnetic switch device.

DETAILED DESCRIPTION

Figure 1:
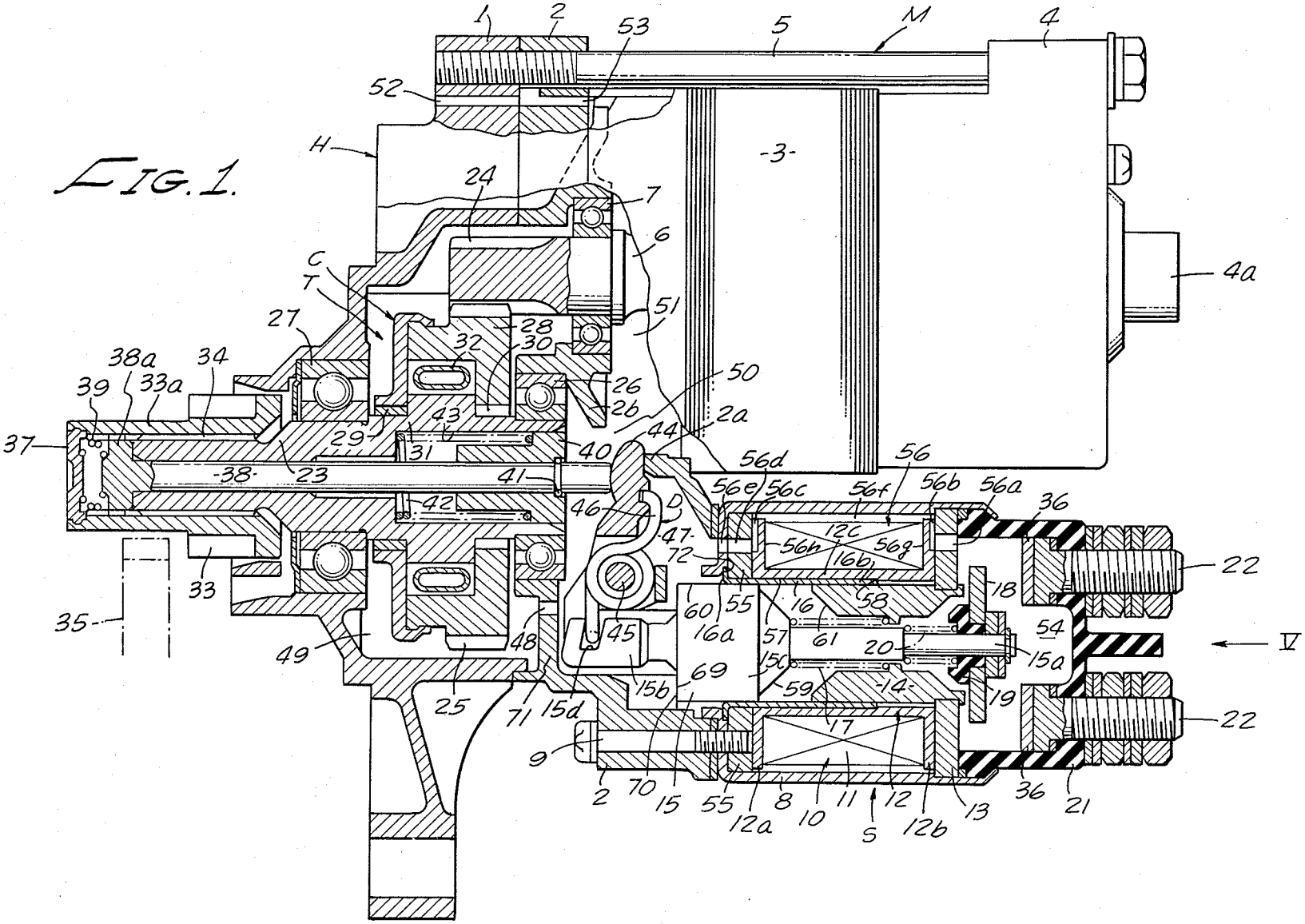
FIG. 1 is a longitudinal sectional view of an electromagnetic switch device according to one embodiment of the present invention, as applied to a starting motor device.

A preferred embodiment of the invention will now be described with reference to the accompanying drawings wherein like reference characters designate like or corresponding parts throughout all the views.

Referring first to FIG. 1, a starting motor device is shown, with which an electromagnetic switch device of the present invention is used. A transmission housing represented as a whole by reference character H comprises a front housing 1 and a rear housing 2 coupled to each other. A starting motor M has a stator 3. The electromagnetic switch device S and the stator 3 are fitted to the rear housing 2 in a manner parallel to each other. Namely, the stator 3 of the starting motor M and a rear bearing bracket 4 are sequentially superposed on the back of the rear housing 2 and fixed to the front housing 1 together with the rear housing 2 by means of bolts 5. A rotor shaft 6 of the starting motor M is rotatably supported on the rear housing 2 and on a bearing portion 4*a* of the bearing bracket 4 by a ball bearing 7 and a bearing bush, not shown, respectively, and the output or front end portion of the rotor shaft 6 projects into the transmission housing H.

The electromagnetic switch device S has a switch housing 8 for supporting a solenoid 11 secured to the rear end of the rear housing 2 by means of bolts 9. A solenoid assembly 10 is accommodated within the switch housing 8. The solenoid 11 is carried on a bobbin 12 inside which are disposed a stationary core 14 connected to the switch housing 8 via an end plate 13, and a movable core 15 which is retractable with respect to the stationary core 14. A sleeve 16 is interposed between a yoke plate 55 and the bobbin 12, and the stationary core 14. The yoke plate 55 forms a magnetic path, but it may be omitted if the switch housing 8 performs the same function. In such case, the housing 8 and the bobbin 12 may be disposed in direct contact with each other. Between the cores 14 and 15 is a return spring 17 which urges the movable core 15 away from the front surface of the stationary core 14. A rod-like rear end portion 15*a* of the movable core 15 extends through the stationary core 14, and slidably mounted at its tip is a moving contact 18 by means of an insulator 19. This moving contact 18 is normally kept at the tip of the movable core 15 under the resiliency of a spring 20. A terminal cap 21 made of an insulating material is fixed to the rear end of the switch housing 8. A pair of terminal bolts 22 are fixed to the cap 21 with their threaded ends extending through an end wall of the cap 21. A pair of fixed contacts 36 facing the moving contact 18 are provided on the heads of the bolts 22. A lead wire (not shown) from a power source is connected to one of the terminal bolts 22, while a lead wire (not shown) from the starting motor M is connected to the other terminal bolt 22.

Inside the transmission housing H are disposed an output shaft 23 and a one-way clutch device T. The one-way clutch device comprises a driving gear 24 formed at the output end of the rotor shaft 6, a driven gear 25 disposed in mesh with the driving gear 24 concentrically with the output shaft 23, and a one-way clutch C interposed between the driven gear 25 and the output shaft 23. The output shaft 23 is rotatably supported by the front and rear housings 1 and 2 by means of the ball bearings 26 and 27, respectively. The one-way clutch C comprises an outer member 28 integrally formed with the driven gear 25 and rotatably supported on the output shaft 23 by means of a pair of bearing bushes 29 and 30, an inner member 31 integrally formed with the output shaft 23, and a roller 32 interposed betwen these inner and outer members 31 and 28.

A cylindrical projection 33*a* from a pinion gear 33 is splined at 34 to the output end portion of the output shaft 23, and projects beyond the front surface of the front housing 1 so as to slide back and forth in the axial direction. A ring gear 35 of the engine is inactive at a predetermined location in the advance of the pinion gear 33 so as to engage with the same upon axial movement of the pinion gear 33.

An opening in the hollow cylindrical projection 33*a* of the pinion gear 33 is closed by a dust preventive plate 37.

The pinion gear 33 is moved by a pinion gear moving device D disposed in the transmission housing H to the position where it engages with the ring gear 35 when the electromagnetic switch device S is actuated.

The pinion gear moving device D comprises a shift rod 38 which slidably extends through the output shaft 23. A push flange 38*a* is formed at the forward end of the shift rod 38, and a coil spring 39 is interposed between the flange 38*a* and the dust plate 37. A spring retainer 40 is fixed on the rear end portion of the shift rod 38 by a snap ring 41, which is accommodated in a guide recess 43 formed in the output shaft 23. A return spring 42 is interposed between the bottom of the recess 43 and the retainer 40 and urges the shift rod 38 in a retracting direction.

The pinion gear moving device D includes a shift lever 44 pivoted to the transmission housing H via a pivot pin 45, and an over-load spring 46 in the form of a coil torsion spring surrounding the pivot pin 45. The shift lever 44 has its tip disposed in pressure contact with the rear end of the shift rod 38 by the force of the over-load spring 46. The over-load spring 46 has its one end urgingly engaging with the shift lever 44 and its other end engaged in an engaging recess 15*d* formed in a hook projection 15*b* of the movable core 15.

The retracting movements of the pinion gear 33, shift rod 38 and shift lever 44 caused by the expanding force of the return spring 42 are restricted by abutting engagement of the tip of the shift lever 44 with a stopper 2*a* defined on the inner wall of the rear housing 2.

Defined in the rear end portion of the rear housing 2 is a space 47 in which the shift lever 44, the over-load spring 46 and the hook projection 15*b* of the movable core 15 are accommodated, which communicates, on one hand, with a space (gear chamber) 49 defined in the front housing 1 and accommodating the one-way clutch C, via a through hole 48 formed in a wall of the rear housing 2 facing the front housing 1, and, on the other hand, with a space 51 defined in the starting motor M and accommodating the front portion of the rotor shaft 6, via an opening 50 defined between the stopper 2*a* of the rear housing 2 and its opposite projection 2*b* formed in the housing 2. The spaces 49 and 51 communicate with the atmosphere via water drain ports 52 and 53 extending through the front and rear housings 1 and 2.

A space 54 is defined in the terminal cap 21 of the electromagnetic switch device S by the peripheral wall of the cap 21, the rear side surface of the end plate 13 and the rear end surface of the stationary core 14, and in which the rear end portion of the movable core 15, the moving contact 18 carried on the same, etc. are accommodated.

The space 54 communicates with the space 47 in the rear housing 2 through a pair of air passages 56 formed through the end plate 13, the bobbin 12, the yoke plate 55 and the switch housing 8. More specifically, as clearly shown in FIG. 2, the solenoid assembly 10 has a pair of through bores 56*a*, 56*a* formed in the end plate 13, a pair of notches 56*b*, 56*b* in the form of channels formed in the rear side surface of the outer peripheral edge of a rear plate or radial flange 12*b* of the bobbin 12, a pair of notches 56*c*, 56*c* similar to the above notches 56*b*, 56*b* formed in the front side surface of the outer peripheral edge of a front plate or radial flange 12*a* of the bobbin 12, a pair of through bores 56*d*, 56*d* formed in the yoke plate 55, and a pair of through bores 56*e*, 56*e* formed in a radially extending front end wall of the switch housing 8 which has a hollow cylindrical configuration, the above through holes and notches being axially aligned with each other. The air passage 56 are each defined by a through bore 56*a* in the end plate 13, a gap 56*s* defined between the front side surface of the same plate 13 and a notch 56*b* in the bobbin flange 12*a*, an annular space 56*f* defined between the outer peripheral surfaces of the front and rear flanges 12*a*, 12*b* of the bobbin 12, the outer peripheral surface of the solenoid 11 and the inner peripheral surface of the switch housing 8, a gap 56*h* defined between a notch 56*c* in the front plate 12*a* of the bobbin 12 and the rear side surface of the yoke plate 55, a through bore 56*d* in the yoke plate 44 and a through bore 56*e* in the front end wall of the switch housing 8.

This construction in which the space 54 in the terminal cap 21 communicates with the space 57 in the rear housing 2, and the space 47 communicates with the atmosphere as previously noted through the air passages 56, prevents the air in the space 54 from being compressed to an increased pressure when the movable core 15 is retracted toward the stationary core 14 thus allowing smooth movement of the core 15. Also, heat radiation of the solenoid 11 is well carried out for prevention of overheating of the solenoid 11. In addition, there is prevented the aforementioned conventional phenomenon in which contraction of the air in the space 54 due to changes in its temperature causes suction of external water into the space 54, since according to the construction of this invention the air in the space 47 passes freely through the air passages 56 into the space 54 on such occasion.

As previously mentioned, the sleeve 16 is fitted in the solenoid assembly 10, which is disposed along the inner peripheral surface of the latter. As distinct from a conventional sleeve shown in FIG. 3, the sleeve 16 according to the present invention has an overall length much shorter than that of the solenoid assembly 10. The sleeve 16 of the present invention has a radially outwardly extending flange-like front end 16*a* tightly clamped between the front end wall of the switch housing 8 and the yoke plate 55, while it has its rear end 16*b* terminating at an intermediate portion of the central axial portion or hollow shaft 12*c* of the bobbin 12 and interposed between the axial portion 12*c* and the stationary core 14. In the construction shown in FIG. 1, the flange-like front end 16*a* of the sleeve 16 is fitted in a stepped shoulder 72 formed in the inner side surface of the end wall of the switch housing 8, and urged against the same inner side surface by the yoke plate 55. A similar stepped shoulder may be formed in the outer side surface of the yoke plate 55 instead of or together with the stepped shoulder 72. The central shaft portion 12*c* of the bobbin 12 has its inner peripheral surface formed with an annular cut or entirely recessed planar surface 57 extending from its front end edge to the above intermediate portion. The sleeve 16 is fitted on this annular cut surface 57 with its tip supportedly located at a stepped shoulder 58 formed at the boundary between the cut surface 57 and the non-cut rear portion of the shaft 12*c* of the bobbin 12.

The movable core 15 has an enlarged main body 15*c* disposed for sliding contact with the inner peripheral surface of the sleeve 16, which has its rear end surface 59 convexly tapered so as to decrease in diameter toward its rear tip in a manner contrary to a conventional movable core shown in FIG. 3. Thus, the movable core 15 has a shortened outer peripheral surface 60 disposed for sliding contact with the sleeve 16 and more forwardly located as compared with the core in FIG. 3. The front end surface 61 of the stationary core 14 facing the tapered rear end surface 59 of the movable core 15 is concavely tapered to compliment the tapered surface 59. The use of the sleeve 16 with its length much shorter than that of the solenoid assembly 10 allows smooth movement of the movable core 15 along the sleeve 16 and also improves heat radiation of the solenoid 11. Further, the sleeve 16 can be mounted in place merely with its flange-like front end tightly held between the switch housing 8 and the yoke plate 55 and its rear end supportedly engaged by the stepped shoulder 58, which simplifies and facilitates mounting of the sleeve. Still further, the arrangement of the present invention is free from the conventional disadvantage that an adhesive, which is applied to the sleeve 16 and the yoke plate 55 for joining them together, can flow out to impede smooth sliding movement of the movable core 15.

FIG. 4 illustrates a variation of the solenoid assembly 10. According to this variation, the outer peripheral surface of the stationary core 14 is formed with an annular cut surface 62 similar to the annular cut surface 57 in FIG. 1, extending from the front end edge to an intermediate portion of the core 14. The sleeve 16 has its rear end portion fitted on this surface 62 with its tip supportedly located at a stepped shoulder 63 formed at the boundary between the cut surface 62 and the non-cut rear surface of the core 14. Further, the non-cut rear portion is thicker than the corresponding portion of the sleeve in FIG. 1 and disposed in direct contact with the inner peripheral surface of the shaft portion 12*c* of the bobbin 12, obtaining improved heat radiation of the solenoid 11. This also permits making the central portion 12*c* of the bobbin 12 thinner to obtain reduced magnetc reluctance.

Figure 6:
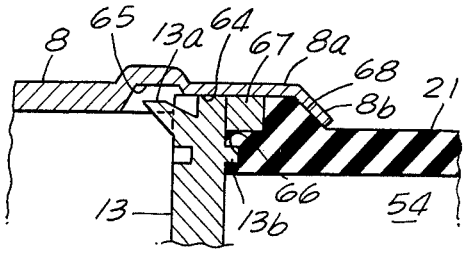
FIG. 6 is a sectional view taken along line VI—VI in FIG. 5.

The rear end portion of the switch housing 8, as more clearly shown in FIG. 6, has its inner peripheral surface formed with an annular stepped shoulder 64 from which rearwardly extend a thinner rear portion 8*a* having a relatively larger inner diameter and an engaging tip 8*b*. The end plate 13 has its outer peripheral edge fitted in the annular stepped shoulder 64 and its inner peripheral edge supportedly fitted on the stationary core 14. A portion of the switch housing 8 forward of the annular stepped shoulder 64 has a part radially outwardly enlarged to form a recess 65 in the corresponding inner surface. Engaged in this recess 65 is a protuberance 13*a* obliquely extending from the outer peripheral edge of the end plate 13 to prevent circumferential rotation of the end plate 13. The end plate 13 has another protuberance 13*b* formed at its rear side surface which is engaged in a recess 66 formed in the front end surface of the terminal cap 21 to engage the end plate 13 with the cap 21. A gasket 67 made of rubber, for example, is interposed between the end plate 13 and the cap 21 for prevention of entry of alien substances such as water into the space 54. The protuberances 13*a*, 13*b* of the end plate 13 and the recess 66 of the cap 21 are formed simultaneously with molding press of the two members 13 and 21 which are made of a resinous material.

Figure 5:
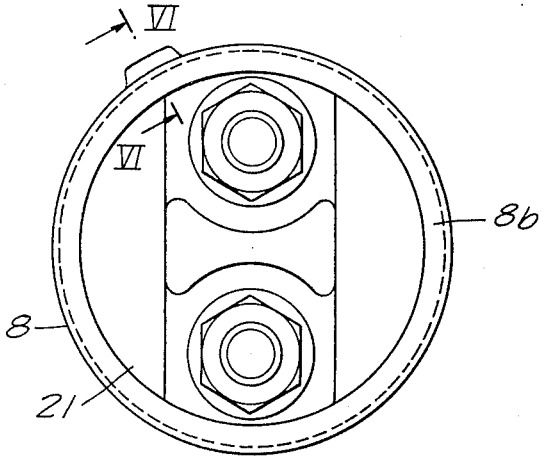
FIG. 5 is an end view taken in the direction of the arrow V in FIG. 1.
Figure 7:
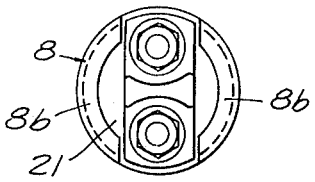
FIG. 7. PRIOR ART
FIG. 7 is a view similar to FIG. 5, showing a conventional caulking joint between the switch housing and the cap.
Figure 8:
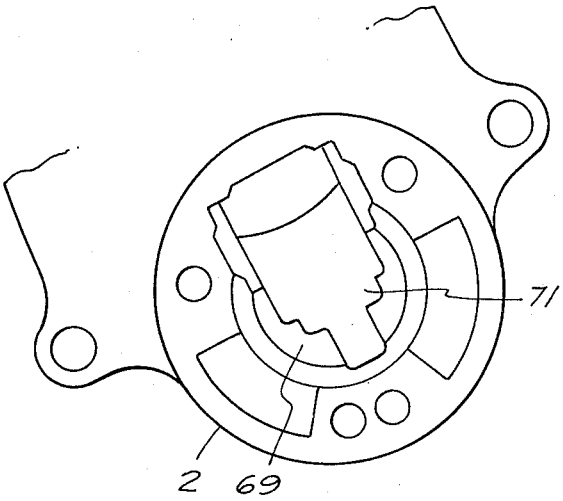
FIG. 8 is a rear end view of part of the rear housing of the starting motor device where the rear end portion of the movable core is arranged.

The engaging rear tip 8*b* of the switch housing 8 which has an annular shape continuously circumferentially extends over the whole periphery of the housing 8, as shown in FIG. 5, and disposed over a tapered outer peripheral surface 68 formed on the cap 21 and caulked thereto along its whole periphery to join the cap 21 to the switch housing 8. As compared with a conventional switch housing shown in FIG. 7, which has an engaging rear tip 8*b* formed of two separate parts and extending only along part of its whole periphery, the caulking of the engaging rear tip 8*b* to the cap 21 can far more effectively prevent rotation of the cap 21 with respect to the housing 8, in cooperation with the engagement of the recess 65 of the switch housing 8 with the protuberance 13*a* of the end plate 13 and the engagement of the protuberance 13*b* of the end plate 13 with the recess 66 of the cap 21. Further, the use of the annular engaging rear tip 8*b* prevents distortion of the housing 8 during the caulking operation. In addition, the load of the switch housing 8 can be evenly applied to the cap 21 along its whole periphery, avoiding damage to the cap 21.

Figure 9:
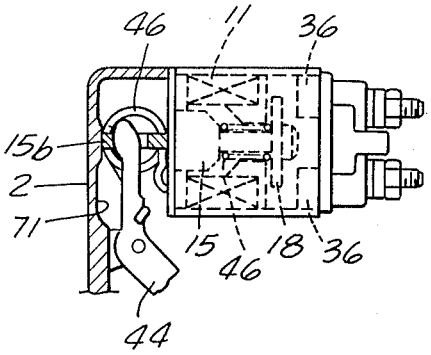
FIG. 9. PRIOR ART
FIG. 9 is a fragmentary sectional view of the hook of a conventional movable core and its peripheral parts.

FIG. 9 illustrates a conventional arrangement of the movable core 15, particularly its hook 15*b* and its neighboring parts. Integrally projected from the front end surface of the enlarged main body of the movable core 15 is the hook 15*b* having a smaller diameter than that of the main body of the core 15. When the solenoid 11 is deenergized, the hook 15*b* is brought into direct contact with an opposed wall surface 71 of the rear housing 2 by the force of the spring 46. This contacting position forms the starting position of the movable core 15. However, the tip of the hook 15*b* which has a small end area collides against the opposed wall surface 71 of the rear housing 2 with a large unit load upon deenergization of the solenoid 11 so that a depression is formed in the wall surface 71. This causes a change in the starting position of the movable core 15 to thereby cause a change in the initial magnetic attraction acting upon the movable core 15. According to the present invention, as clearly shown in FIG. 1, a substantially annular stopper surface 69 is integrally formed on an inner surface of the rear housing 2 facing the front end surface 70 of the cylindrical enlarged main body 15*c* of the movable core 15. As the movable core 15 is moved leftward, the above front end surface 70 is brought into pressure contact with the stopper surface 69 having a large contacting surface area to accurately determine the starting position of the movable core 15. This construction prevents collision of the hook 15*b* against the opposed wall surface 71 of the rear housing 2 when the movable core 15 is moved leftward, as shown in FIG. 1, avoiding the aforementioned disadvantages, since the tip of the hook 15*b* is positioned at a slight distance from the wall surface 71 when the stopper surface 69 is in contact with the main body 15*c* of the movable core 15.

Next, the operation of the illustrated embodiment will now be described. When the start switch of the engine is operated so that a current is fed to the solenoid 11 of the electromagnetic switch device S, the movable core 15 is drawn to the stationary core 14 whereby the hook 15*b* integral with the movable core 15 causes the shift lever 44 to rotate around the pivot pin 45 via the over-load spring 46 in the counter-clockwise direction, as viewed in FIG. 1, thereby pushing through its tip the shift rod 38 in the forward direction (to the left in FIG. 1). By the advance of the shift rod 38, the push flange 38*a* advances the pinion gear 33 via the buffer spring 39 to a position where it engages with the ring gear 35. At this time, if the teeth of both gears 33, 35 are not in alignment with each other so that the flanks of them abut against each other, the pinion gear 33 is stopped at this abutting position, however, the shift rod 38 advances to a position where it comes into pressure contact with the dust preventive plate 37 while compressing the buffer spring 39, and thereafter, the movable core 15 continues to move toward a position where the moving contact 18 comes into contact with the paired fixed contacts 36 against the force of the over-load spring 17, thereby actuating the starting motor M.

The rotation of the rotor shaft 6 is transmitted at a reduced rate to the output shaft 23 via the driving gear 24, the driven gear 28, and the one-way clutch C, so that the output shaft 23 rotates the pinion gear 33 with a large driving torque.

As the pinion gear 33 begins to rotate to bring its teeth into alignment with those of the ring gear 35, the pinion gear 33 is advanced by the repulsive force stored in the buffer spring 39 and the over-load torsion spring 46 so as to be placed into perfect meshing engagement with the ring gear 35 to drive the latter for engine cranking.

As the engine starts to operate, the ring gear 35 rotates at a high speed and so rotates the pinion gear 33 at a speed higher than the speed of rotation of the driven gear 28, disengaging the one-way clutch C, so that the reverse load of the ring gear 35 is not transmitted back to the starting motor M, thus preventing the motor from being overrun.

When the start switch is turned off, the movable core 15 of the electromagnetic switch device S is returned to its original position by the return spring 17 whereupon the moving contact 18 moves away from the fixed contacts 36 to deenergize the starting motor M. At the same time, the shift rod 38 is returned by the return spring 42 so that the pinion gear 33 is disengaged from the ring gear 35.

While a preferred embodiment of the invention has been shown and described herein, it is apparent to those skilled in the art that various changes and modifications may be made therein without departing from the spirit of the invention and the scope of the appended claims.

What is claimed is:

1. An electromagnetic switch device, comprising in combination: a cylindrical housing adapted to be fixed to a stationary member of a device to which said electromagnetic switch device is applied, said housing having a radially extending end wall located adjacent said stationary member; a bobbin accommodated within said housing, a solenoid carried by said bobbin, a cap member fixed to one end of said housing opposite to said end wall of said housing, an annular yoke member interposed between said housing and said cap member and extending radially of said housing, a stationary core positioned inside said bobbin, said cap member defining therein an internal space in cooperation with said yoke member and said stationary core, a movable core movable relative to said stationary core and extending in part through said stationary core into said internal space in said cap member, a fixed contact secured in said cap member, a moving contact mounted on said movable core in face-to-face relation to said fixed contact, resilient means interposed between said movable core and said stationary core and urging said movable core in a direction away from said stationary core; said yoke member, said bobbin and said end wall of said housing being juxtaposed axially of said housing, and air passage means extending through said yoke member, said bobbin and said end wall of said housing to establish communication between said internal space in said cap member with the atmosphere outside of said electromagnetic switch device.

2. The electromagnetic switch device as claimed in claim 1, including a second annular yoke member interposed between said end wall of said housing and said bobbin and extending radially of said housing, said air passage means also extending through said second annular yoke member.

3. The electromagnetic switch device as claimed in claim 2, wherein said bobbin includes a pair of radially extending flanges at opposite ends thereof, and said air passage means are defined by at least one first through hole formed in said first-mentioned yoke member, a gap between one side surface of said first-mentioned yoke member and at least one notch formed in an outer side surface of corresponding one of said flanges of said bobbin in alignment with said first through hole and extending to an outer peripheral surface of said corresponding flange, a gap between said bobbin and an inner peripheral surface of said housing, a gap between at least one second notch formed in an outer side surface of the other of said flanges of said bobbin and extending to an outer peripheral surface of said other flange and an associated side surface of said second yoke member, at least one second through hole formed in said second yoke member in alignment with said second notch, and at least one third through hole formed in said end wall of said housing in alignment with said second through hole.

4. An electromagnetic device, comprising in combination: a cylindrical housing adapted to be fixed to a stationary member of a device to which said electromagnetic switch device is applied, said housing having a radially extending end wall located adjacent said stationary member, a bobbin accommodated within said housing, said bobbin having a hollow cylindrical axial portion, a solenoid carried by said bobbin; a cap member fixed to one end of said housing opposite to said end wall of said housing; a first annular yoke member interposed between said housing and said cap member and extending radially of said housing, a second annular yoke member interposed between said end wall of said housing and said bobbin and extending radially of said housing, a stationary core positioned inside said bobbin, said cap member defining therein an internal space in cooperation with said yoke member and said stationary core, a movable core movable relative to said stationary core and extending in part through said stationary core into said internal space in said cap member, a fixed contact secured in said cap member, a moving contact mounted on said movable core in face-to-face relation to said fixed contact, resilient means interposed between said movable core and said stationary core and urging said movable core in a direction away from said stationary core, said first annular yoke member, said bobbin, said second annular yoke member and said end wall of said housing being juxtaposed axially of said housing, air passage means extending through said first annular yoke member, said second annular yoke member, said bobbin and said end wall of said housing to establish communication between said internal space in said cap member with the atmosphere outside of said electromagnetic switch device, and a sleeve fitted in said hollow cylindrical axial portion of said bobbin along an inner peripheral surface thereof, said sleeve having one end thereof engaged between said end wall of said housing and said second annular yoke member and an opposite end thereof terminating at an intermediate portion of said bobbin and supported by an annular stepped shoulder formed in at least one of opposed surfaces of said bobbin and said stationary core.

5. The electromagnetic switch device as claimed in claim 4, wherein said one end of said sleeve has a radially extending annular flange engaged in a second annular stepped shoulder formed in at least one of opposed surfaces of said end wall of said housing and said second annular yoke member.

6. The electromagnetic switch device as claimed in claim 4, wherein said movable core has an end face facing said stationary core and tapered in such a manner that it has a diameter decreasing toward a tip thereof, said stationary core having an end face facing said movable core and tapered in a manner complimenting said tapered end face of said movable core.

7. The electromagnetic switch device as claimed in claim 4, wherein said stationary core is formed with said first-mentioned stepped shoulder by which said opposite end of said sleeve is supported, a portion of said stationary core located opposite to said movable core with respect to said first-mentioned stepped shoulder being disposed in direct contact with an associated inner peripheral surface of said bobbin.

8. An electromagnetic switch device, comprising in combination: a cylindrical housing adapted to be fixed to a stationary member of a device to which said electromagnetic switch device is applied, said housing having a radially extending end wall located adjacent said stationary member, a bobbin accommodated within said housing, a solenoid carried by said bobbin, a cap member fixed to one end of said housing opposite to said end wall of said housing, an annular yoke member interposed between said housing and said cap member and extending radially of said housing, a stationary core positioned inside said bobbin, said cap member defining therein an internal space in cooperation with said yoke member and said stationary core, a movable core movable relative to said stationary core and extending in part through said stationary core into said internal space in said cap member, a fixed contact secured in said cap member, a moving contact mounted on said movable core in face-to-face relation to said fixed contact, resilient means interposed between said movable core and stationary core and urging said movable core in a direction away from said stationary core, said yoke member, said bobbin and said end wall of said housing being juxtaposed axially of said housing, air passage means extending through said yoke member, said bobbin and said end wall of said housing to establish communication between said internal space in said cap member with the atmosphere outside of said electromagnetic switch device, wherein said one end of said housing includes an annular stepped shoulder formed in an inner peripheral surface thereof, a portion extending from said stepped shoulder toward said cap member and having an inner diameter larger than the remainder of said housing, and at least one recess formed in said annular peripheral surface thereof and located inwardly adjacent said stepped shoulder, said yoke member having at least one protuberance engaged in said recess of said housing, said cap member having one end thereof disposed in contact with said yoke member and formed with an annular ridge on an outer peripheral surface thereof, said portion of said housing with a larger inner diameter having an annular end edge disposed over said annular ridge of said cap member and caulked thereto along the entire periphery thereof.

9. The electromagnetic switch device as claimed in claim 8, including at least one second protuberance formed on one of opposed surfaces of said yoke member and said cap member, and at least one recess engaging with said second protuberance, whereby relative circumferential dislocation of said yoke member and said cap member is prevented.

10. The electromagnetic switch device as claimed in claim 8, including an annular sealing member interposed between opposed surfaces of said yoke member and said cap member.

11. An electromagnetic switch device, comprising in combination: a cylindrical housing adapted to be fixed to a stationary member of a device to which said electromagnetic switch device is applied, said housing having a radially extending end wall located adjacent said stationary membe and having a central opening; a bobbin accommodated within said housing, a solenoid carried by said bobbin, a cap member fixed to one end of said housing opposite to said end wall of said housing, an annular yoke member interposed between said housing and said cap member and extending radially of said housing, a stationary core positioned inside said bobbin, said cap member defining therein an internal space in cooperation with said yoke member and said stationary core, a movable core extending through said central opening in said end wall of said housing and movable relative to said stationary core, said movable core extending in part through said stationary core into said internal space in said cap member, said movable core having an enlarged main body, and a hook portion projected from said main body in a direction away from said stationary core and having a diameter smaller than that of said main body, a fixed contact secured in said cap member, a moving contact mounted on said movable core in face-to-face relation to said fixed contact, resilient means interposed between said movable core and said stationary core and urging said movable core in a direction away from said stationary core, said yoke member, said bobbin and said end wall of said housing being juxtaposed axially of said housing, air passage means extending through said yoke member, said bobbin and said end wall of said housing to establish communication between said internal space in said cap member with the atmosphere outside of said electromagnetic switch device, and stopper means having a stopper surface disposed for pressure contact with said enlarged main body of said movable core to prevent movement of the latter in a direction away from said stationary core beyond a predetermined position.

12. The electromagnetic switch device as claimed in claim 11, wherein said stopper surface of said stopper means is formed on a surface of said stationary member of said device to which the electromagnetic switch device is adapted to be applied, said surface of said stationary member facing said movable core.

13. The electromagnetic switch device as claimed in claim 12, wherein said stopper surface of said stopper device has a substantially annular shape and disposed for pressure contact with an associated surface of said enlarged main body of said movable core in the vicinity of a peripheral edge thereof.

14. The electromagnetic switch device as claimed in claim 12, wherein said stationary member further includes a wall surface more distant from said movable core than said stopper surface, said stopper surface being disposed such that when said stopper surface is in pressure contact with said enlarged main body of said movable core, a tip of said hook portion of said movable core being positioned at a slight distance from said wall surface of said stationary member.

* * * * *

UNITED STATES PATENT AND TRADEMARK OFFICE

CERTIFICATE OF CORRECTION

PATENT NO. : 4,404,533

DATED : September 13, 1983

INVENTOR(S) : Kurihara, Kinoshita, Watanabe and Sato

It is certified that error appears in the above—identified patent and that said Letters Patent is hereby corrected as shown below:

Column 1, line 66 change "in" to "is" accommodated.
Column 6, line 32 change "57" to "47" in the rear...
Column 7, line 51 change "magnetc" to "magnetic" reluctance.
Column 12, line 29 change "membe" to "member" and having...

Signed and Sealed this

*Twentieth* Day of *March 1984*

[SEAL]

*Attest:*

GERALD J. MOSSINGHOFF

*Attesting Officer*

*Commissioner of Patents and Trademarks*